United States Patent [19]

Diel et al.

[11] Patent Number: 5,063,855

[45] Date of Patent: Nov. 12, 1991

[54] PROJECTILE ARRANGEMENT

[75] Inventors: Rainer Diel, Düsseldorf; Achim Sippel, Ratingen; Jürgen Meyer, Cologne; Heinz-Josef Kruse, Ratingen, all of Fed. Rep. of Germany

[73] Assignee: Rheinmetall GmbH, Düsseldorf, Fed. Rep. of Germany

[21] Appl. No.: 600,414

[22] Filed: Oct. 16, 1990

[30] Foreign Application Priority Data

Nov. 11, 1989 [DE] Fed. Rep. of Germany ..... 3937665

[51] Int. Cl.[5] ..... F42B 12/06; F42B 14/06

[52] U.S. Cl. ..... 102/521

[58] Field of Search ..... 102/520, 521, 522, 523

[56] References Cited

U.S. PATENT DOCUMENTS

| | | | |
|---|---|---|---|
| 2,996,011 | 8/1961 | Dunlap | 102/523 |
| 3,738,279 | 6/1973 | Eyre et al. | 102/521 |
| 3,745,926 | 7/1973 | Mertz et al. | 102/521 |
| 4,372,217 | 2/1983 | Kirkendall et al. | 102/521 |
| 4,469,027 | 9/1984 | Burns et al. | 102/521 |
| 4,671,181 | 6/1987 | Romer et al. | 102/518 |
| 4,756,255 | 7/1988 | Rosenberg et al. | 102/521 |

FOREIGN PATENT DOCUMENTS

3811597A1 10/1989 Fed. Rep. of Germany .

OTHER PUBLICATIONS

"Internationale Wehrrevue", vol. 5, 1988, p. 474.

*Primary Examiner*—Michael J. Carone

*Attorney, Agent, or Firm*—Spencer & Frank

[57] ABSTRACT

A projectile arrangement including a subcaliber projectile body and a segmented, discardable propelling cage sabot provided with a common form locking zone for the transmission of the acceleration forces. To reduce the notch effect on the projectile body, and thus the danger of breakage, due to the conventional thread grooves in the form locking zone, particularly in long, slender penetrators made of a breakage susceptible tungsten heavy metal, a novel form locking connection for the inner form locking region between the propelling cage and the projectile body is provided. This novel form locking connection is characterized in that in the region of the form locking zone beneath the exterior gas pressure receiving surface of the sabot, only the exterior surface of the projectile body is provided with preferably annular microgrooves and the surrounding inner surface of the sabot is smooth. The microgrooves are produced preferably by non-cutting shaping such as, for example, rolling or pressing in, and are configured as arcuate recesses having a relatively flat groove bottom and pointed lands between adjacent recesses. When the projectile arrangement is fired, the microgrooves of the relatively hard projectile body press themselves into the previously smooth interior surface of the relatively soft sabot, and thus produce a corresponding form locking connection only at the moment of firing.

17 Claims, 4 Drawing Sheets

50
12(38)
50
46
16
14
48
42
48
54

12(38)
44
14
62
56
40
14
40
52

60
58
12(38)
62
56
40
14
40
52

PROJECTILE ARRANGEMENT

BACKGROUND OF THE INVENTION

The present invention relates to a projectile arrangement including a subcaliber projectile body and a segmented discardable propelling cage sabot. More particularly, the present invention relates to a projectile arrangement including a subcaliber projectile body, a segmented, discardable propelling cage sabot which at least partially surrounds the projectile body and a common form locking zone formed in this enclosed region for transmitting acceleration forces from the propelling cage sabot to the projectile body with the form locking zone being composed, at least in part, of corresponding thread grooves or annular grooves structurally worked into the exterior surface of the projectile body and into the interior surface of the propelling cage sabot or the propelling cage sabot segments.

A projectile arrangement of the above type is disclosed, for example, in German Patent No. 2,234,219 corresponding to U.S. Pat. No. 4,671,181. The armor piercing projectile disclosed there has a breakage susceptible core of tungsten carbide which is encased by a ductile steel jacket. The conventional threaded grooves for a form locking connection with the sabot are here cut into the outer surface of the steel jacket or casing of the projectile body so as to reduce the susceptibility to breakage of the brittle heavy metal core and prevent breaking of the core during penetration of armored targets, particularly those composed of multiple armor plates. Particularly in such armors composed of several substances, the different characteristics of the material of the individual armor layers, e.g. alternating layers of armor steel, plastic and ceramic material, generate strong transverse forces on the slender penetrator rod leading to premature breakage and failure of the penetrator.

This prior art projectile, due to its breakage susceptibility reducing steel casing configuration, is excellently suited for use against armored targets, but its drawback is the reduction of kinetic energy due to a reduction in the average density of the projectile body as a result of the "lightweight" contribution of the steel casing. Moreover, the manufacture of this prior art projectile body is rather complicated and expensive.

Customarily, form locking zones are composed of thread grooves and not of individual annular grooves. The reason for this is that it is much easier from a manufacturing point of view to use available tools (thread cutters) for cutting a thread into the central inner bore of the propelling cage, which, for example, has a diameter of only 42 mm (equal to the diameter of the projectile body) than to cut equidistant annular grooves into the inner bore with a rotary cutter that has to be newly placed for each annular groove.

A subcaliber penetrator made of a tungsten alloy and equipped with a segmented propelling cage is shown, for example, at page 474 of the periodical "Internationale Wehrrevue" (International Weapons Review) Vol. 5/1988. This penetrator has a form locking zone which is composed of cut-in thread grooves and extends over almost the entire length of the projectile. If the projectile is employed against multi-armor plate targets, the generated transverse forces may lead to premature breakage and loss of performance of the penetrator, with the sharp notches in the bottom of the thread acting, so to speak, as predetermined break locations.

SUMMARY OF THE INVENTION

It is an object of the present invention to provide a projectile arrangement of the above type which, with guaranteed firing resistance, permits economical manufacture and simultaneously reduces the breakage susceptibility of the penetrator in connection with transverse stresses while increasing its penetrating power in the target.

The above object is achieved according to the present invention by an improved projectile arrangement of the type including a subcaliber projectile body, a segmented, discardable propelling cage sabot having at least one radially extending flange and a gas pressure receiving surface extending rearwardly from the flange, with the sabot at least partially surrounding a portion of the length of an outer cylindrical surface of the projectile body to provide a common form locking zone extending along the surrounded portion, and means within the form locking zone for transmitting the acceleration forces from the sabot to the projectile body, with this means for transmitting being composed, at least in part, of corresponding thread grooves or annular grooves structurally worked into the outer surface of the projectile body and into the interior surface of the propelling cage sabot. The common form locking zone is divided into at least first and second locking zone regions extending over its length, with the first form locking zone region being disposed in front of the second form locking zone region, extending rearwardly beyond the radially extending flange to a length adjacent the outer gas pressure receiving surface. The portions of the interior surface of the sabot and of the outer surface of the projectile body within the first form locking zone region are provided with the above mentioned corresponding grooves, the portion of the outer surface of the projectile body within the second form locking zone region, and beneath the exterior gas pressure receiving surface of the sabot, is provided only with circumferentially extending microgrooves, and, the portion of the interior surface of the sabot within the second form locking zone region is smooth.

More generally, the common form locking zone between the projectile body and the propelling cage is here divided into at least two form locking zone regions (I and II), with the forward form locking zone region (I) being provided, over a shortened longitudinal extent, with the conventional common and corresponding thread or annular grooves in the interior surface of the propelling cage sabot and on the exterior surface of the projectile body, while in the rear form locking zone region (II), beneath the exterior gas pressure receiving surface of the sabot, flat shallow microgrooves are provided only on the exterior surface of the projectile body, and the interior surface of the propelling cage sabot or propelling cage sabot segments in this rear region is smooth. For manufacturing technology reasons and in order to provide for uniform release of the propelling cage segments, the microgrooves are preferably configured as annular grooves. With this arrangement according to the invention, the application of an additional steel casing may therefore be omitted.

In comparison to the conventional tungsten heavy metal penetrators whose thread grooves for forming a lock with the propelling cage sabot are cut directly into the surface of the brittle tungsten heavy metal, the breakage susceptibility of an extremely slender projectile body according to the present invention is considerably reduced during the penetration of modern layered armors or structured targets involving great transverse stresses. This results in an improvement of the final ballistic performance. The reduction of breakage susceptibility of the tungsten heavy metal penetrators according to the present invention is evident in their stress concentration factor for tensile and bending stresses which, due to the measures according to the invention, is reduced by about 40% to 55%.

Another advantage of the present invention is that with the inventive configuration of the form locking zone it is now also possible to employ propelling cages which have the required firing resistance and which are provided in a basic material, e.g. light metal, plastic, with tensile strength increasing longitudinal fibers, e.g., carbon fibers, glass fibers, etc. In the past, such propelling cage materials could not be employed because cutting in of the form locking zone or, more precisely, the thread grooves, by means of a thread cutter caused the supporting fibers in the interior surface of the propelling cage to be cut. As a result, the tensile increasing effect of these fibers was destroyed again, so that only the basic material, e.g. plastic (which by itself did not have the necessary strength to transfer the developing push/pull stresses), was able to transfer the firing stresses, causing these propelling cages to fail.

Thus, in a propelling cage according to the invention, only a very short front form locking region (I) with the conventional thread grooves needs to be provided to ensure transport and mutual axial fixing between the sabot and the projectile, while this manufacturing work is completely unnecessary to form the rear locking region (II) of the propelling cage. This noticeably reduces manufacturing costs.

The inventive microgrooves on the projectile body can advantageously be employed equally well for projectile arrangements involving the conventional dual-flange propelling cages (push/pull sabot) and single-flange propelling cages (pull sabot).

As one feature of the invention, it is provided that the preferably annular microgrooves in the exterior surface of the projectile body are produced by non-cutting shaping, for example, by rolling in or pressing in. Due to the fact that no material is cut out of the surface of the projectile body and a relatively flat or wide groove bottom exists ("soft notch"), the breakage susceptibility of the projectile body in the target is reduced considerably. Additionally, this measure constitutes an economical and waste-free manufacturing method for the form locking zone.

According to further embodiments of the invention, the form locking zone may be provided with a further region which, depending on the type of sabot, i.e., pull or push/pull, is disposed either between the above described front (first) form locking zone region and the rear (second) form locking zone region, or in front of the front (first) form locking zone region. This further form locking zone region is provided likewise with corresponding thread or annular grooves on both the interior surface of the sabot and the outer or exterior surface of the projectile body but with these grooves being approximately one half of the height and/or the width of conventional grooves provided in the first region.

The invention will be explained and described below in greater detail with reference to embodiments thereof that are illustrated in the drawing figures.

FIG. **4*a*** is a partial sectional view showing a form locking zone region II according to the invention provided with microgrooves.

Figure 4A:
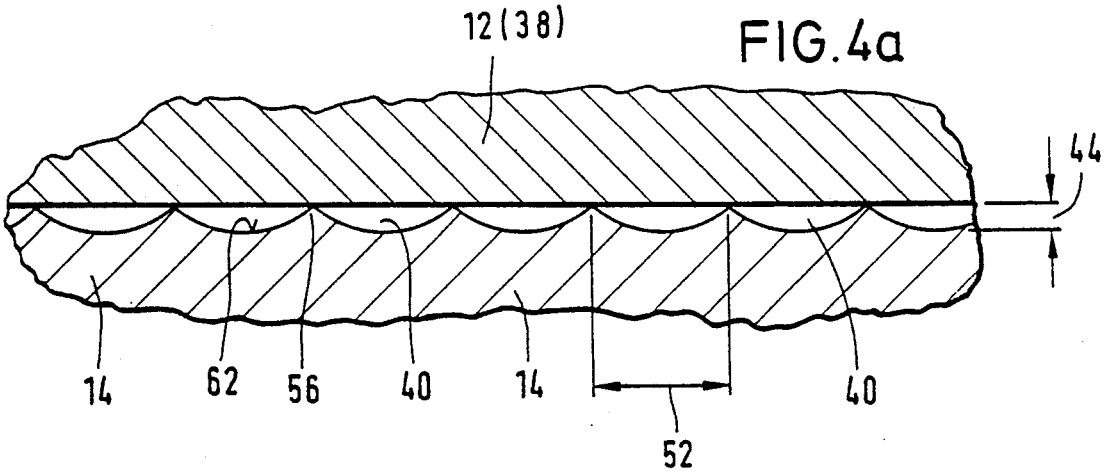

FIG. **4*b* shows the form locking zone region II provided with microgrooves according to the invention of FIG. 4*a*** during the firing acceleration of the projectile arrangement in a gun barrel.

Figure 5:
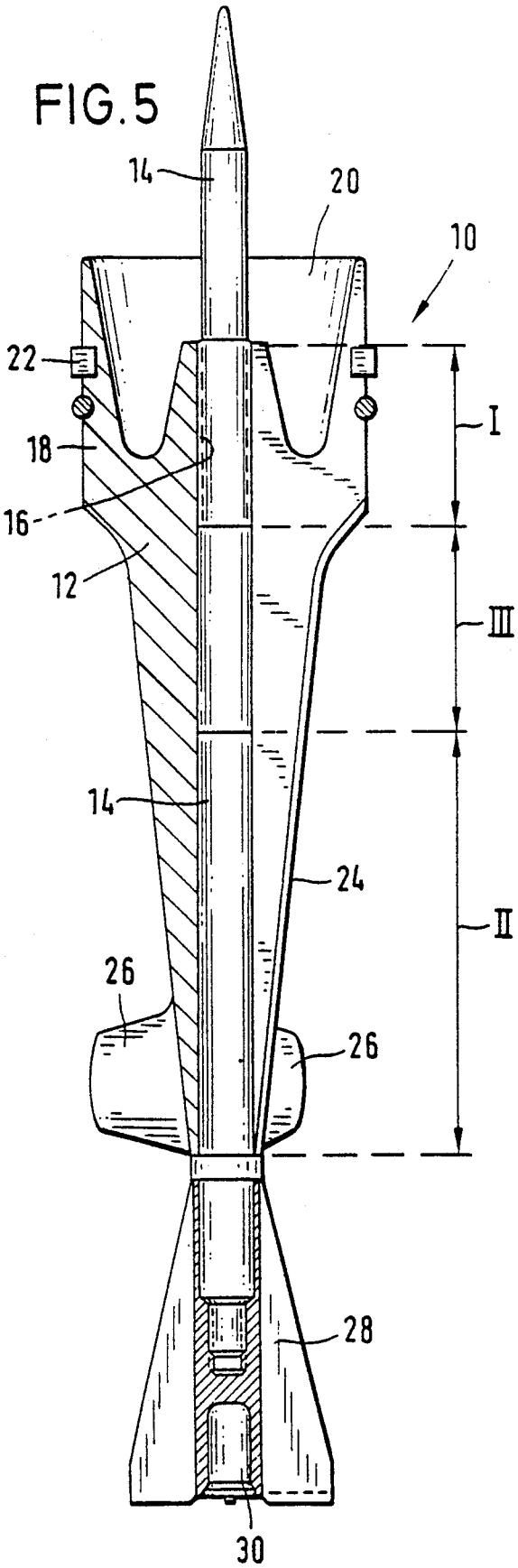
Figure 6:
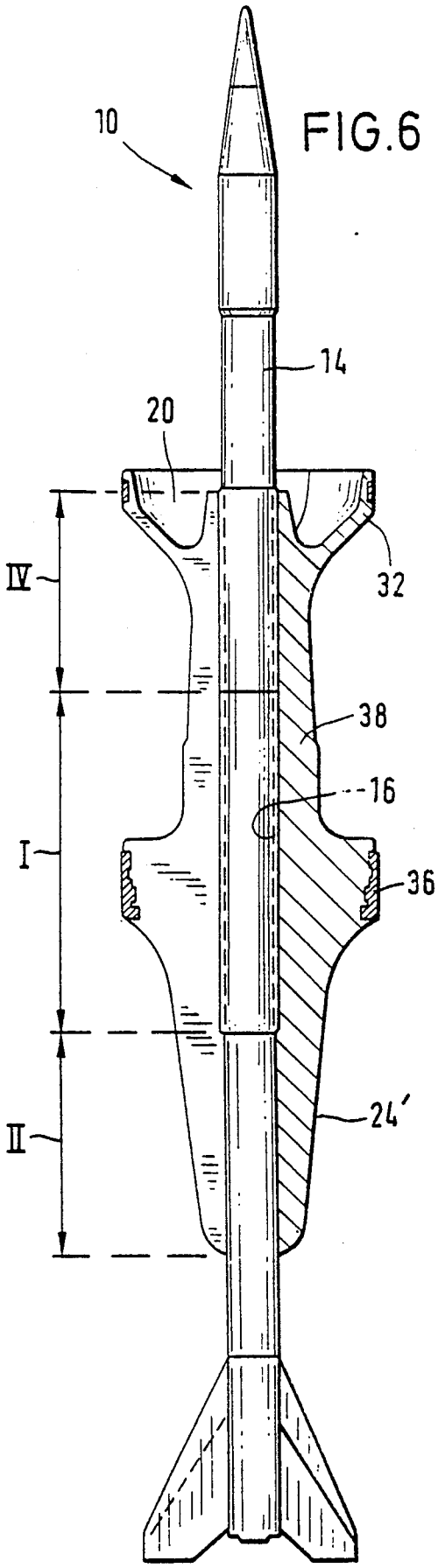

FIGS. 5 and 6 shows two further embodiments of projectile arrangements according to the invention provided with a three-region form locking zone.

Figure 7:
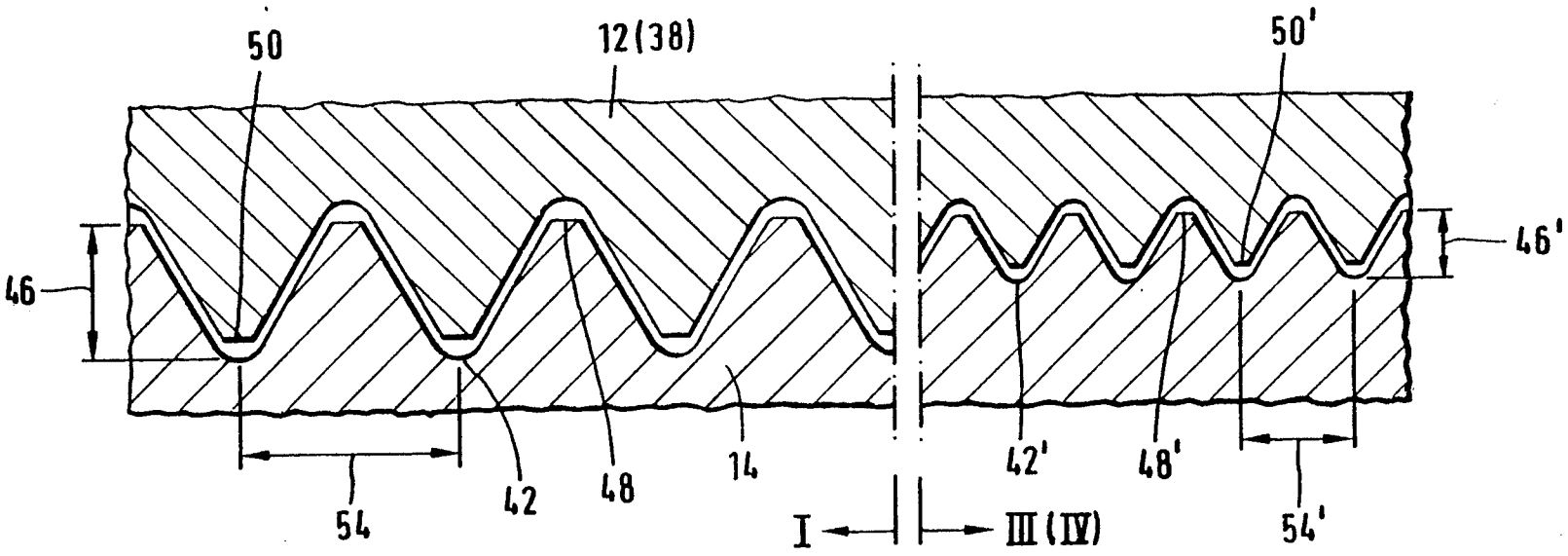

FIG. 7 is a partial sectional view of the form locking region I and the form locking region III or IV of the embodiments of FIGS. 5 and 6, respectively.

DETAILED DESCRIPTION OF THE PREFERRED EMBODIMENTS

Figure 1:
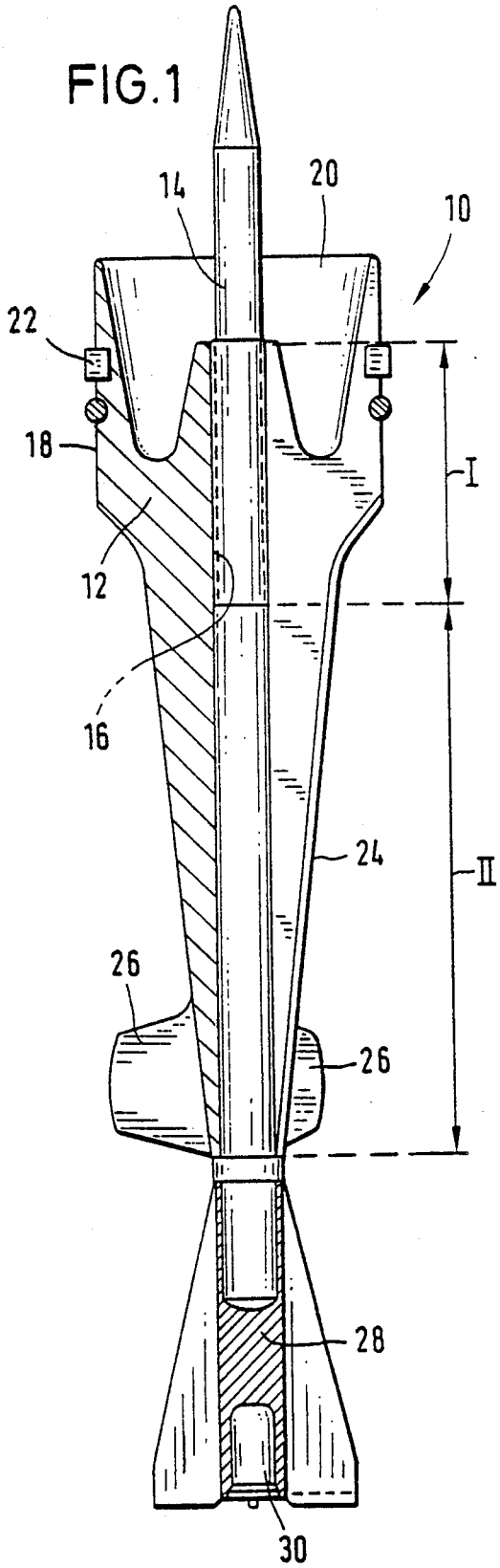
FIG. 1 shows a first embodiment of a projectile arrangement according to the invention including a single-flange propelling cage sabot, i.e., a pull sabot.

In FIG. 1, the reference numeral 10 identifies a projectile arrangement which includes a subcaliber projectile body or penetrator 14 made of a breakage susceptible tungsten heavy metal (THM), and a segmented, discardable sabot 12 which partially surrounds the projectile 14 along a portion of the length of its cylindrical outer surface. In order to transmit the acceleration forces from propelling cage sabot 12 to the projectile body 14 when the projectile arrangement 10 is fired, the projectile body 14 and the propelling cage sabot 12 have a common form locking zone 16. This form locking zone 16 is generally composed of corresponding conventional thread grooves which are cut into the exterior or outer surface of projectile body 14 and into the interior surface of the propelling cage sabot 12 or, more precisely, the propelling cage sabot segments, e.g., three, forming the sabot.

In the illustrated embodiment, propelling cage sabot 12 is configured as a pull sabot having only a single frontal radially extending pressure flange 18. The three propelling cage segments are held together in the circumferential region of the pressure flange 18 by a circumferential guide and holding band 22 which simultaneously seals the inner gun barrel against the gas pressure of the propelling charge. At its front, pull sabot 12 is provided with an air pocket 20 and at its rear with an elongate conical portion having an external gas pressure receiving surface 24 which extends rearwardly from the rear end of the flange 18. In the gas pressure receiving surface 24, the dividing grooves between the individual propelling cage segments are sealed in the conventional manner against the gas pressure by means of a vulcanized-on sealing cuff, for example, of rubber, or by means of attached sealing beads. In order to center and support projectile arrangement 10 in the gun barrel, the rearward end region of propelling cage sabot 12 may be provided with three additional radially extending supporting webs 26. To stabilize the projectile in flight, the slender projectile body 14 is provided with a fin guide mechanism 28 at its tail and possibly with a tracer set 30.

According to this embodiment of the present invention, the common form locking zone 16 is subdivided into two form locking zone regions I and II, with only the forward form locking zone region I being provided, over a shortened longitudinal extent, with the conventional common, corresponding thread grooves in the inner surface of the propelling cage sabot 12 and on the exterior surface of the projectile body 14. In the rear form locking zone region II, which extends over the major portion of the exterior gas pressure receiving surface 24 of propelling cage sabot 12, circumferentially extending microgrooves 40 (see FIG. 4*a*), which are preferably annular, are provided only on the exterior surface of the projectile body 14, while the interior surface of the propelling cage sabot 12, or the propelling cage segments, is smooth. Thus, projectile body 14 is provided with the microgrooves 40, which are significant for the present invention, only in its rear form locking zone region II which extends over approximately two thirds of the total length of the propelling cage sabot 12 or more specifically the form locking zone 16.

Figure 2:
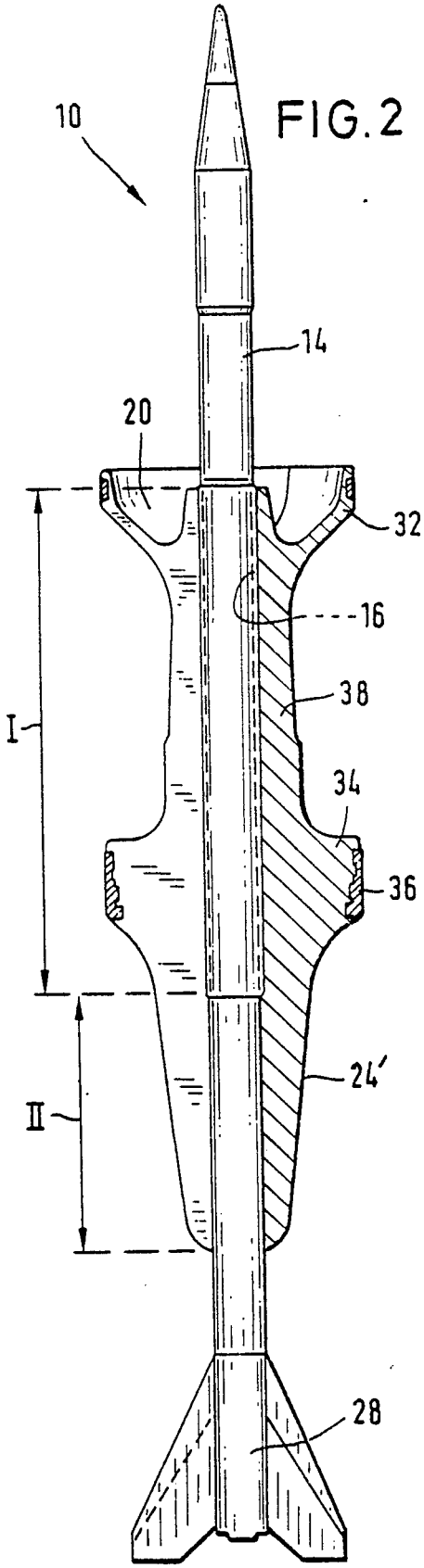
FIG. 2 shows a second embodiment of a projectile arrangement according to the invention including a dual-flange propelling cage sabot, i.e., a push/pull sabot.

FIG. 2 shows, as a further embodiment of the invention, a projectile arrangement 10 having a conventional dual-flange propelling cage sabot 38, i.e. a push/pull sabot. Propelling cage sabot 38 includes a forward radially extending guide flange 32 and a rear radially extending pressure flange 34. To provide a gas seal, a circumferential sealing band 36 is provided in the circumferential region of pressure flange 34. Starting at pressure flange 34, a conical tail section of propelling cage sabot 38 provided with a conical gas pressure receiving surface 24' extends rearwardly. In the manner described above, this gas pressure receiving surface 24' is sealed against the existing gas pressure along the dividing grooves of the propelling cage segments.

As a distinction over the embodiment of a pull sabot shown in FIG. 1, the forward form locking zone region I provided with the conventional thread grooves of the push/pull sabot 38 of FIG. 2 extends over about the front two thirds of the length of the propelling cage sabot 38, (i.e., the length of the zone 16) while the rear form locking zone region II provided with the microgrooves according to the invention, i.e. only on projectile body 14, extends over only about one third of the length.

Figure 3:
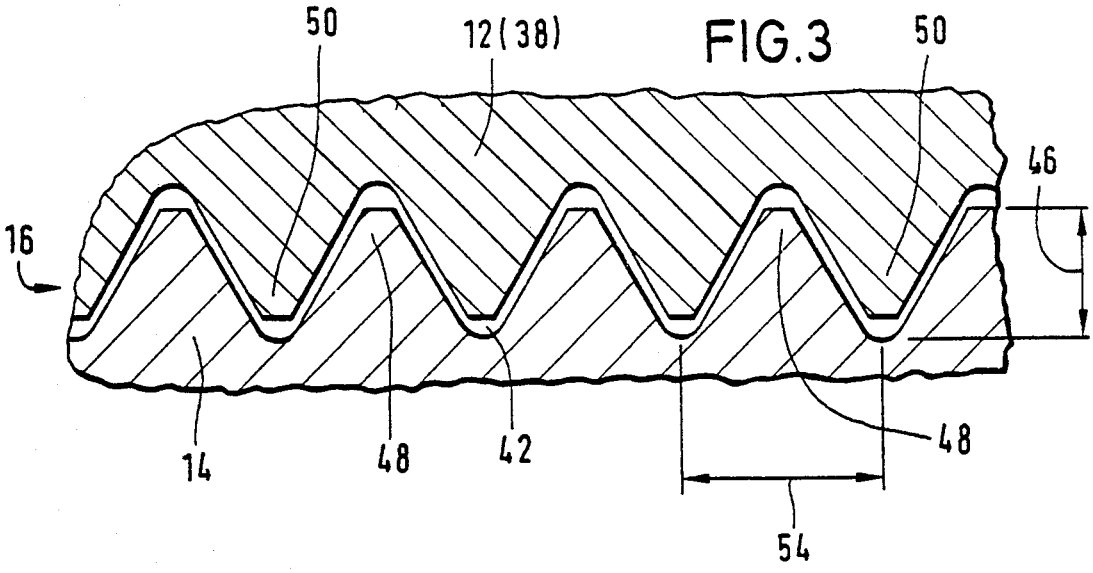
FIG. 3 is a partial sectional view showing a conventional form locking zone region I with corresponding thread grooves between the projectile body and the propelling cage.

FIG. 3 is a sectional view of the conventional form locking zone region I which has thread grooves 42 cut into the exterior surface of projectile body 14 and into the inner surface of propelling cage sabot 12 or 38. Due to the chip creating manner of cutting the threads, the lattice structures of the propelling cage and projectile body materials are disadvantageously weakened in this form locking zone region. The thread notches 42 in the exterior surface of projectile body 14 act, so to speak, as inadvertent "desired" break locations and constitute a considerable weakening of the material. In the form locking zone region I, the conventional thread teeth 48, 50 have a defined height 46 which approximately corresponds to the base width 54 of the respective thread teeth.

In the case of the region II containing microgrooves 40 in the exterior surface of projectile body 14 as shown in FIG. 4*a*, the situation is quite different. The interior surface of the propelling cage sabot 12 or 38 in is here smooth. The annular microgrooves 40 in the exterior surface of the projectile body 14 are preferably produced by non-cutting shaping such as, for example, by rolling or pressing the microgrooves in by means of appropriate tools. In this way, the microgrooves 40 are formed as arcuate rolled-in portions on a circle having a large radius so as to form a flattened groove bottom 62 with pointed lands 56 between adjacent microgrooves 40 in the exterior surface of the projectile body 14. With this special configuration of the microgrooves 40, the notch and breakage susceptibility of the THM penetrator 14 is further reduced.

The height 44 of the microgrooves 40 here lies approximately between 20% and 5%, preferably at about 10%, of the height 46 of the conventional thread grooves 42, and the width 52 of the microgrooves 40 is between 30% and 10%, preferably about 25%, of the width 54 of the conventional thread grooves 42. As a numerical example, a conventional thread as shown in FIG. 3, for example, has a thread tooth height 46 of about 1.3 mm and a thread base width 54 of about 1.85 mm. In contrast thereto, the height 44 of a microgroove 40 is about 0.1 mm and its width 52 is about 0.5 mm.

When compared to otherwise identical parameters, with the microgrooves 40 according to the invention, the stress concentration factor $\alpha_{KZ}$ under tensile stresses is reduced from 4.7 to 2.1 compared to a conventional thread groove (FIG. 3) and the stress concentration factor $\alpha_{KB}$ under bending stress is reduced from 4.0 to 2.3. This constitutes a reduction in stress concentration factors of 55% and 42%, respectively.

Figure 4B:
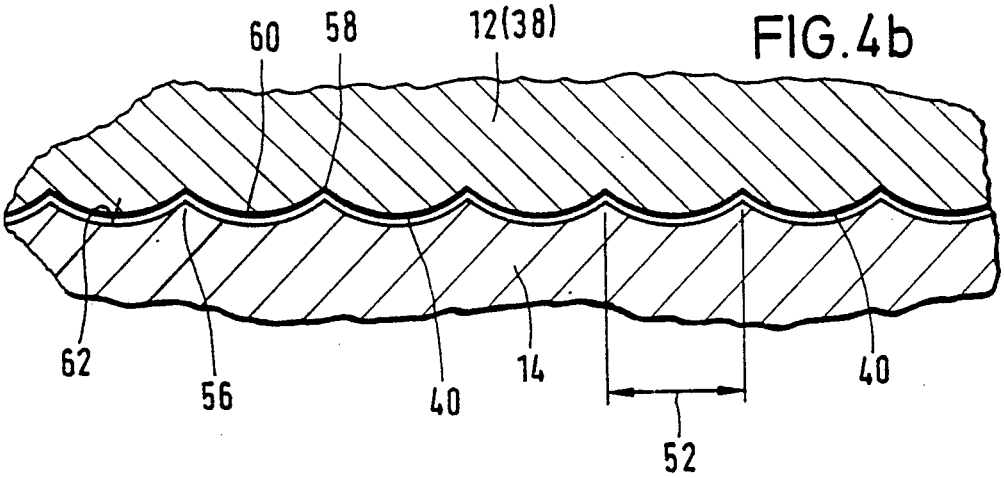

FIG. 4*b* shows the conditions during acceleration of the projectile arrangement according to the invention in the gun barrel. Upon application of the gas pressure to the gas pressure receiving surface 24 or 24', the previously smooth interior surface of the relatively "soft" propelling cage sabot 12 or 38 (composed, for example, of an aluminum alloy) is pressed into the microgrooves 40 on the exterior surface of the relatively "hard" projectile body 14 (composed, for example, of THM). This results in "impressed" microgrooves or microthreads having a pointed microgroove depth 58 and a round microgroove rise 60 in the interior surface of the propelling cage sabot 12 or 38. On the basis of this manner of functioning, fiber reinforced propelling cage materials can also be employed without any problems.

The form locking zone configuration with microgrooves according to the invention is intended primarily for large-caliber ammunition of, for example, a caliber of 120 mm employing subcaliber kinetic energy projectiles. However, successful firing has also been accomplished in the "small" caliber range of 45 mm.

In the further embodiment of a projectile arrangement 10 including a single-flange propelling cage sabot 12 and a projectile body 14 shown in FIG. 5, at least one further form locking zone region III is provided between the forward form locking zone region I provided with the conventional annular or thread grooves 42 (FIG. 3) and the rear form locking zone region II provided with microgrooves 40 (FIG. 4*a*). The annular or thread grooves of this further form locking zone region III have a height and width of about half the height and width of the conventional annular or thread grooves 42 in the forward, first form locking zone region I. Moreover, preferably, twice as many thread grooves per unit length are provided in the region III then in the region I. In this embodiment, the regions I and III each extend over approximately one quarter of the total length of the propelling cage sabot 12, i.e., the form locking zone 16. However, as shown, the region II extends over slightly more than one half of the total length, and the region III is slightly longer than region I.

A corresponding configuration of form locking zone 16 for a dual-flange propelling cage sabot 38 is shown in FIG. 6. In this propelling cage sabot 38, at least one further form locking zone region IV is provided in front of a slightly shortened (compared to FIG. 2) form locking zone region II provided with the microgrooves 40 according to the invention and even ahead of a further shortened (as compared to FIG. 2) form locking zone region I provided with the conventional annular or thread grooves 42. This form locking zone region IV has annular or thread grooves of a height and/or width of about half the height and width of the conventional thread grooves 42 in the middle form locking zone region I, and likewise is preferably provided with twice as many grooves per unit length. In the illustrated embodiment, the regions II and IV each extend over slightly less than about thirty percent of the total length of the zone 16.

FIG. 7 shows a sectional view of the conventional form locking zone region I adjacent to one further form locking zone region III according to FIG. 5, or to the further form locking zone region IV shown in FIG. 6. The region I is provided, as shown in FIG. 3, with thread grooves 42 cut into the exterior surface of the projectile body 14 and into the inner surface of propelling cage sabot 12 or 39. In the form locking zone region I, the conventional thread teeth 48, 50 have a defined height 46 which approximately corresponds to the base width 54 of the respective thread teeth.

In the form locking zone region III or IV, the annular or thread grooves 42' have a height 46' and width 54' of about half the height 46 and width 54 of the thread grooves 42 in the adjacent form locking zone region I. The further form locking zone region III or IV is preferably provided with twice as many grooves 42' per unit length in comparison to those grooves 42 in the form locking region I.

Thus, even though they are reduced in height 46' and width 54', these annular or thread grooves 42' are sufficient for transmitting acceleration forces from the propelling cage sabot 12 or 38 to the projectile body 14 in the regions III and IV. At the same time, the grooves 42' are suitable to reduce the breakage susceptibility of the projectile body 14, because the length of the form locking zone region I of the embodiments according to FIGS. 5 and 6 is shortened in comparison with the length of the form locking zone regions I shown in the embodiments according to FIGS. 1 and 2.

The invention now being fully described, it will be apparent to one of ordinary skill in the art that any changes and modifications can be made thereto without departing from the spirit or scope of the invention as set forth herein.

What is claimed is:

1. In a projectile arrangement including a subcaliber projectile body, a segmented, discardable propelling cage sabot having at least one radially extending flange and a gas pressure receiving surface extending rearwardly from said flange, with said propelling cage sabot at least partially surrounding a portion of the length of an outer cylindrical surface of said projectile body to provide a common form locking zone extending along the surrounded portion, and means, disposed within said form locking zone, for transmitting the acceleration forces from said propelling cage sabot to said projectile body, with said means for transmitting being composed, at least in part, of one of corresponding thread grooves and annular grooves structurally worked into said outer surface of said projectile body and into an interior surface of said propelling cage sabot; the improvement wherein: said common form locking zone is divided into at least first and second locking zone regions extending over its length; said first form locking zone region is disposed in front of said second form locking zone region, and extends rearwardly beyond said radially extending flange to a length adjacent said outer pressure receiving surface; the portions of said interior surface of said propelling cage sabot and of said outer surface of said projectile body within said first form locking zone region are provided with said corresponding grooves; the portion of said outer surface of said projectile body within said second form locking zone region, beneath said exterior gas pressure receiving surface of said propelling cage sabot, is provided only with microgrooves; and, the portion of said interior surface of said propelling cage within said second form locking zone region is smooth.

2. A projectile arrangement as defined in claim 1 wherein said microgrooves are annular.

3. A projectile arrangement as defined in claim 1, wherein said microgrooves have a height which lies between about 20% and 5% of the height of said corresponding grooves in said first form locking zone region.

4. A projectile arrangement as defined in claim 3 wherein said height of said microgrooves is about 10% of said height of said corresponding grooves in said first form locking zone region.

5. A projectile arrangement as defined in claim 3 wherein said microgrooves have a width which is between 30% and 10% of the width of said grooves in said first form locking zone region.

6. A projectile arrangement as defined in claim 5 wherein said width of said microgrooves is approximately 25% of said width of said corresponding grooves in said first form locking zone region.

7. A projectile arrangement as defined in claim 1 wherein said microgrooves have a width which is between 30% and 10% of the width of said grooves in said first form locking zone region.

8. A projectile arrangement as defined in claim 1 wherein: said propelling cage sabot is a single flange pull sabot; said first form locking zone region extends from a front end of said form locking zone rearwardly over approximately one third of the length of said form locking zone; and, said second form locking zone region extends over the remaining length of said form locking zone.

9. A projectile arrangement as defined in claim 1 wherein: said propelling cage sabot is a dual-flange push/pull sabot; said first form locking zone region extends from a front end of said form locking zone rearwardly over approximately two thirds of the length of said form locking zone; and said second form locking zone region extends over the remaining length of said form locking zone.

10. A projectile arrangement as defined in claim 1 wherein: said propelling cage sabot is a single-flange pull sabot; at least one further form locking zone region is provided between said first and said second form locking zone regions; said cooperating grooves in said first form locking zone region are of a predetermined size and width; and, the respective portions of said interior surface of said sabot and of said outer surface of said projectile body within said further form locking zone region are provided with cooperating grooves having a height and width of approximately half the height and width of said grooves in said first form locking zone region.

11. A projectile arrangement as defined in claim 10 wherein: said cooperating grooves are thread grooves; and approximately twice the number of said thread grooves are provided over the same length extension in said further form locking zone region as compared to the number of said thread grooves provided in said first form locking zone region.

12. A projectile as defined in claim 1 wherein: said propelling cage sabot is a dual-flange push/pull sabot; at least one further form locking zone region is provided in front of said first locking zone region; said cooperating grooves in said first form locking zone region are of a predetermined size and width; and the respective portions of said interior surface of said sabot and of said outer surface of said projectile body within said further form locking zone region are provided with cooperating said grooves having a height and width of approximately half the height and width of said grooves in said first form locking zone region.

13. A projectile arrangement as defined in claim 12 wherein: said cooperating grooves are thread grooves; and approximately twice the number of said thread grooves are provided over the same length extension in said further form locking zone region as compared to the number of said thread grooves provided in said first form locking zone region.

14. A projectile arrangement as defined in claim 1 wherein: said microgrooves in said outer surface of said projectile body are arcuate recesses with the arc being of a circle having a large radius to form a relatively flat groove bottom; and said recesses are positioned to form pointed lands between adjacent said recesses.

15. A projectile as defined in claim 14 wherein said microgrooves in said outer surface of said projectile body are non-cuttingly formed.

16. A projectile arrangement as defined in claim 15 wherein said microgrooves are one of rolled in and pressed in recesses.

17. A projectile arrangement as defined in claim 1 wherein said propelling cage sabot is formed of a softer material than the material of said projectile body, whereby a form locking connection between said sabot and said projectile body in said second form locking zone region is formed only during firing of said arrangement in that said interior surface of said propelling cage sabot is pressed against said microgrooves due to gas pressure developed by the ignited propelling charge acting on said gas pressure receiving surface and corresponding microgrooves are then created on said interior surface of said propelling cage sabot.

* * * * *